US005747742A

United States Patent [19]

Nelson

[11] Patent Number: 5,747,742

[45] Date of Patent: May 5, 1998

[54] PROTECTIVE WRAPPING FOR SPLICED CABLE CONNECTORS

[75] Inventor: Edward Dennis Nelson, Stone Mountain, Ga.

[73] Assignee: Lucent Technologies, Inc., Murry Hill, N.J.

[21] Appl. No.: 543,460

[22] Filed: Oct. 16, 1995

[51] Int. Cl.[6] ..... H01R 4/00

[52] U.S. Cl. ..... 174/84 R; 439/730; 439/932; 174/DIG. 8

[58] Field of Search ..... 174/84 R, 87, 174/DIG. 8; 439/730, 932

[56] References Cited

U.S. PATENT DOCUMENTS

| | | | |
|---|---|---|---|
| 2,806,214 | 9/1957 | Forney, Jr. | 439/730 |
| 3,022,543 | 2/1962 | Baird, Jr. et al. | 18/57 |
| 3,772,635 | 11/1973 | Frey et al. | 439/403 |
| 3,821,182 | 6/1974 | Baird, Jr. et al. | 260/91.7 |
| 3,858,158 | 12/1974 | Henn et al. | 439/403 |
| 4,048,428 | 9/1977 | Baird, Jr. et al. | 526/343 |
| 4,118,596 | 10/1978 | Bassett et al. | 174/87 |
| 4,176,240 | 11/1979 | Sabia | 174/23 C |
| 4,188,443 | 2/1980 | Mueller et al. | 428/216 |
| 4,194,039 | 3/1980 | Mueller | 428/213 |
| 4,274,900 | 6/1981 | Mueller et al. | 156/229 |
| 4,299,241 | 11/1981 | Seiller Pierre FX | 132/48 R |
| 4,341,921 | 7/1982 | Simpson | 174/84 R |
| 4,415,217 | 11/1983 | Clabburn et al. | 439/488 |
| 4,450,318 | 5/1984 | Scardina et al. | 174/84 R |
| 4,509,820 | 4/1985 | Murata et al. | 350/96.21 |
| 4,870,117 | 9/1989 | Levy | 523/173 |
| 5,079,051 | 1/1992 | Garland et al. | 428/34.9 |
| 5,125,848 | 6/1992 | Zimmerly | 439/291 X |
| 5,313,702 | 5/1994 | Fischer, Jr. et al. | 29/883 X |
| 5,382,470 | 1/1995 | Vicik | 428/334 |

*Primary Examiner*—Kristine L. Kincaid
*Assistant Examiner*—Chau N. Nguyen

[57] ABSTRACT

A protectively packaged connector for connecting multiple conductors is disclosed. The connector has multiple parts, each of which is provided with a protective covering of heat shrink thermoplastic film. The connector is assembled in the normal manner but with the film in place. This protects the connector from outside contaminants and is especially useful for filled connectors which readily attract contaminants because of the sticky waterproof filling compound.

6 Claims, 4 Drawing Sheets

PROTECTIVE WRAPPING FOR SPLICED CABLE CONNECTORS

FIELD OF INVENTION

The invention relates to connectors used for connecting corresponding electrical conductors of cables at a splice location. More particularly, the invention relates to a protective wrapping for such connectors so that the spliced conductors are not exposed to contaminants and do not become corroded.

BACKGROUND OF THE INVENTION

In the communications industry it is commonplace for two cables to be connected at one or more splice locations. Typically, each cable comprises a multitude of individual conductors which must be spliced to join the cables. It has been estimated that over two billion splice connections are made each year in the telephone industry, with the labor costs alone being staggering. It is obviously important for these splice connections that they be durable and, preferably, permanent so that the need for replacement splices is minimized.

Typically, the individual conductor ends to be spliced are brought and held together in multiple contact connectors such as one which is disclosed in U.S. Pat. No. 3,858,158 to Henn et al., the disclosure of which is incorporated herein by reference. To protect the spliced conductors, the connector is commonly packed with a filling compound which is meant to prevent the conductors from contacting or being contacted by water and other contaminants, inasmuch as exposure of spliced conductors to water and other contaminants lowers the lifetime of the connections by causing deterioration and corrosion of the connector, its filling compound and the conductors. Not only is the capacitance balance of transmission lines and hence the electrical performance upset by such exposure but also serious corrosion may occur and telephone company personnel are forced to spend many hours at considerable expense repairing lines and restoring telephone service following such damage to connectors and conductors. These filling compounds have been shown to be, at times, inadequately protective of the individual conductors and spliced ends against corrosion, and the filling compound itself oftentimes becomes contaminated from contact with water, fungus, insects, insect droppings, dust, dirt and other contaminants. In addition, it is not always desirable to add filling compound to the connector. For example, adding filling compound raises the manufacturing costs of the connector and hence the cost of splicing.

Thus, it is apparent that a method and/or material for preventing contamination and corrosion of multiple conductor connectors is needed, which will protect the connector and conductors even if filling compound is not present and will protect the filling compound as well, if it is present. One technique which has been developed to decrease the contamination of the filling compound and corrosion of the conductors is the inclusion of a fungicide and corrosion inhibitor in the filling compound, as taught in a co-pending patent application, Ser. No. 08/489,423 to Bair et al., filed Jun. 12, 1995.

A technique for use in protection of the spliced portions of an optical fiber is taught by Murata et al., in U.S. Pat. No. 4,509,820, and involves wrapping the fiber in a heat shrinkable polymeric tube capable of shrinking in the radial direction. The heat shrinkable tube is then heated by application of an electrical resistance heating element, whereupon the heat shrink material shrinks and forms a protective coating around the optical fiber. This simple technique would not work for connectors because the many conductors connected to the connector would get in the way and would not allow the film to adequately cover the connector.

Heat shrinkable thermoplastic films have been used for various applications, probably most typically for packaging of food products such as meat, cheese, poultry and the like. A heat shrinkable film is a film that is stretched and oriented while it is being cooled so that later, when used for packaging, it will, upon being rewarmed, shrink tightly around the package contents. Blown film made from plasticized polyvinylchloride (PVC) is the most widely used heat shrink film. Other commonly used thermoplastics are polyethylenes and polypropylenes. The manufacture of a single layer heat shrink film may generally be accomplished by extrusion of a thermoplastic resinous material which has been heated to or above its flow or melting point from an extrusion die in, for example, either tubular or planar (sheet) form, followed by post-extrusion cooling. The stretching or orienting of the film may be conducted at some point during the cool-down while the film is still hot and at a temperature within its orientation temperature range, followed by completion of the cooling. Alternatively, after the postextrusion cooling, the relatively thick extrudate is then reheated to a temperature within its orientation temperature range and stretched to orient or align the crystallites and/or molecules of the material, and then cooled again.

The heat shrink film may then be formed into a pouch or bag, perhaps utilizing an appropriate adhesive, and the product inserted into the pouch or bag. Alternatively, a sheet of the material may be utilized to overwrap the product. The enclosed product is then subjected to elevated temperatures, for example, by passing the enclosed product through a hot air tunnel or by placing it in hot water. This causes the enclosing heat shrinkable film to shrink around the product to produce a tight wrapping that closely conforms to the contours thereof. Such packaging methods, and others, are well known to those of skill in the art.

The above general outline for manufacturing heat shrink films is not meant to be all-inclusive and other such processes are well known to those in the art. For example, see U.S. Pat. Nos. 4,274,900, 4,299,241, 4,194,039, 4,188,443, 4,048,428, 3,821,182, 3,022,543 and 5,079,051. The disclosures of these patents are generally representative of such processes and are hereby incorporated by reference.

As is apparent from the foregoing discussion, it is a problem in the industry that spliced cable connectors are oftentimes contaminated by exposure to water, dirt, dust, fungus, insects, and other contaminants. Contamination is certain to occur in connectors that contain filling compound, inasmuch as the compound is greasy and is readily contaminated with dirt, insects, insect droppings, etc. These contaminants then migrate through the filling compound, contact the metal surfaces and cause corrosion. This contamination is, eventually, likely to cause decay of the filling compound and corrosion of the conductors. Loss of telephone service will result along with the need for expensive repair by the telephone company. The present invention is a way to avoid such problems by protectively wrapping the connector and thus eliminating contact with contaminants. The wrap is a barrier that prevents contaminants from contacting the surface of the sticky filling compound.

SUMMARY OF THE INVENTION

The foregoing problems are overcome by the connector of the present invention, which is protectively packaged by a wrapping of heat shrinkable plastic film. More particularly, the connector may be composed of three pieces which are each separately enclosed in heat shrinkable film at the point of manufacture, where cleanliness conditions are better than those in the field. The pieces are then assembled in the normal manner, in the field with the plastic wrap still in place, to hold the multiple conductors. Thus each individual connector piece or part is protected by its own wrap, even when its connector is assembled, and failure of one portion of the wrap can affect only its individual part.

One consideration in the development of the invention was the desirability or necessity of making splices or other connections in the field. It would be extremely difficult and even impossible to assemble a connector in the field and then wrap a heat shrink film over the connector with its conductors. Under such circumstances, the operational environment is less than ideally clean, and, further, the operator would have to carry with him the necessary tools for shrinking the film. Moreover, the film would not shrink and mold as tightly about the connector because the presence of the conductors to and from the connector would block access of the film to the connector. Thus, voids and crevices in the film wrap would most likely result, allowing moisture, dirt, etc. to reach the connector and its conductors.

The present invention calls for protectively wrapping the individual pieces at the point of their manufacture or after their fillage with filling compound and assembling the pieces as usual for the particular connector. The shrink wrap covering does not prevent the pieces from being assembled in their normal fashion and does not prevent any necessary or usual electrical or physical connections between the pieces and the conductors attached thereto.

Because the pieces are wrapped before they are assembled, the maximum amount of possible surface area of the pieces remains covered by the film after assembly of the pieces because the film is pierced only where necessary during assembly to provide electrical connection between the pieces and the conductors.

Heat shrinkable plastics known in the art can be used in the invention. In addition, known methods of applying and shirnking heat shrinkable films can be used in the invention.

DETAILED DESCRIPTION

Figure 1:
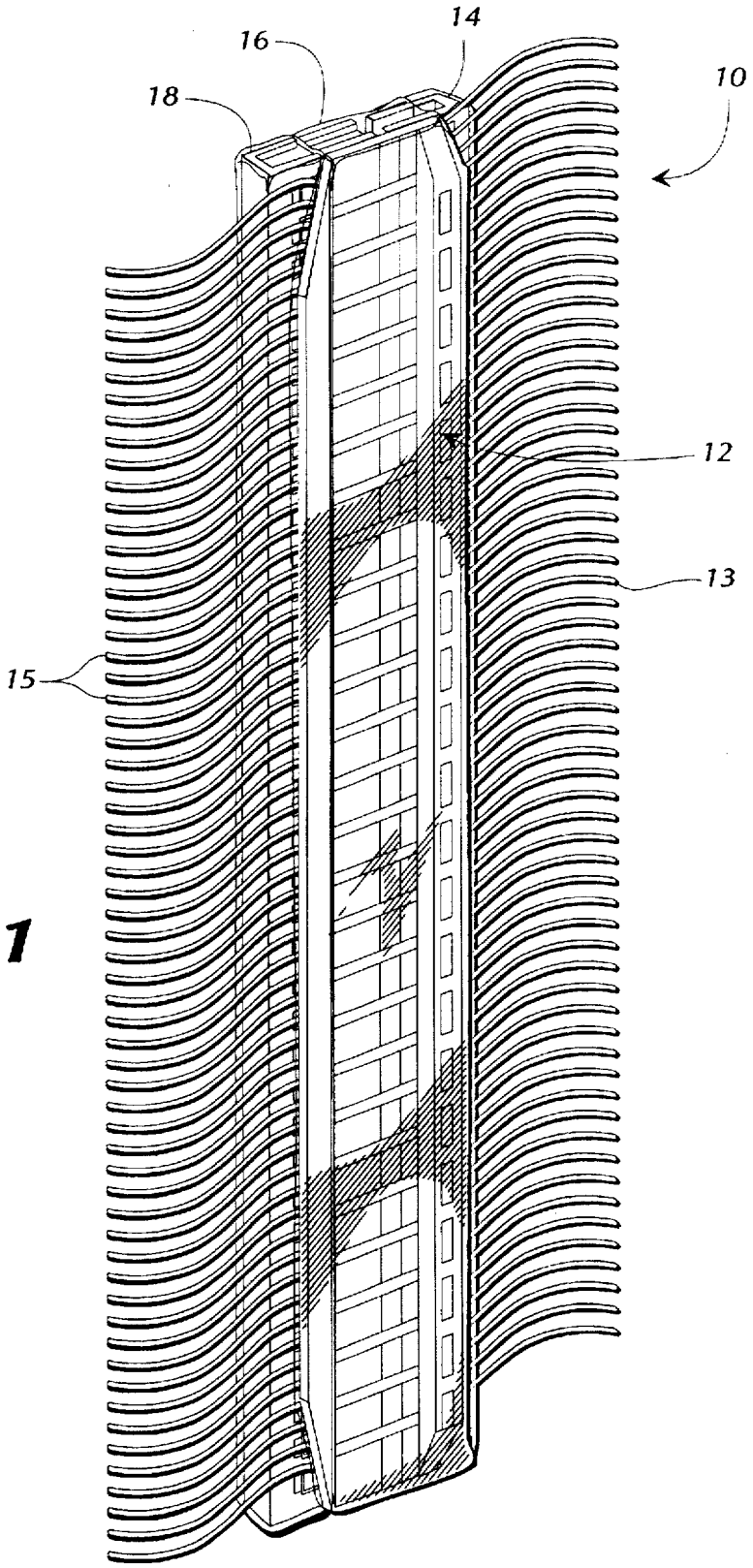
FIG. 1 is a perspective view showing an assembled, protectively packaged connector.
Figure 2:
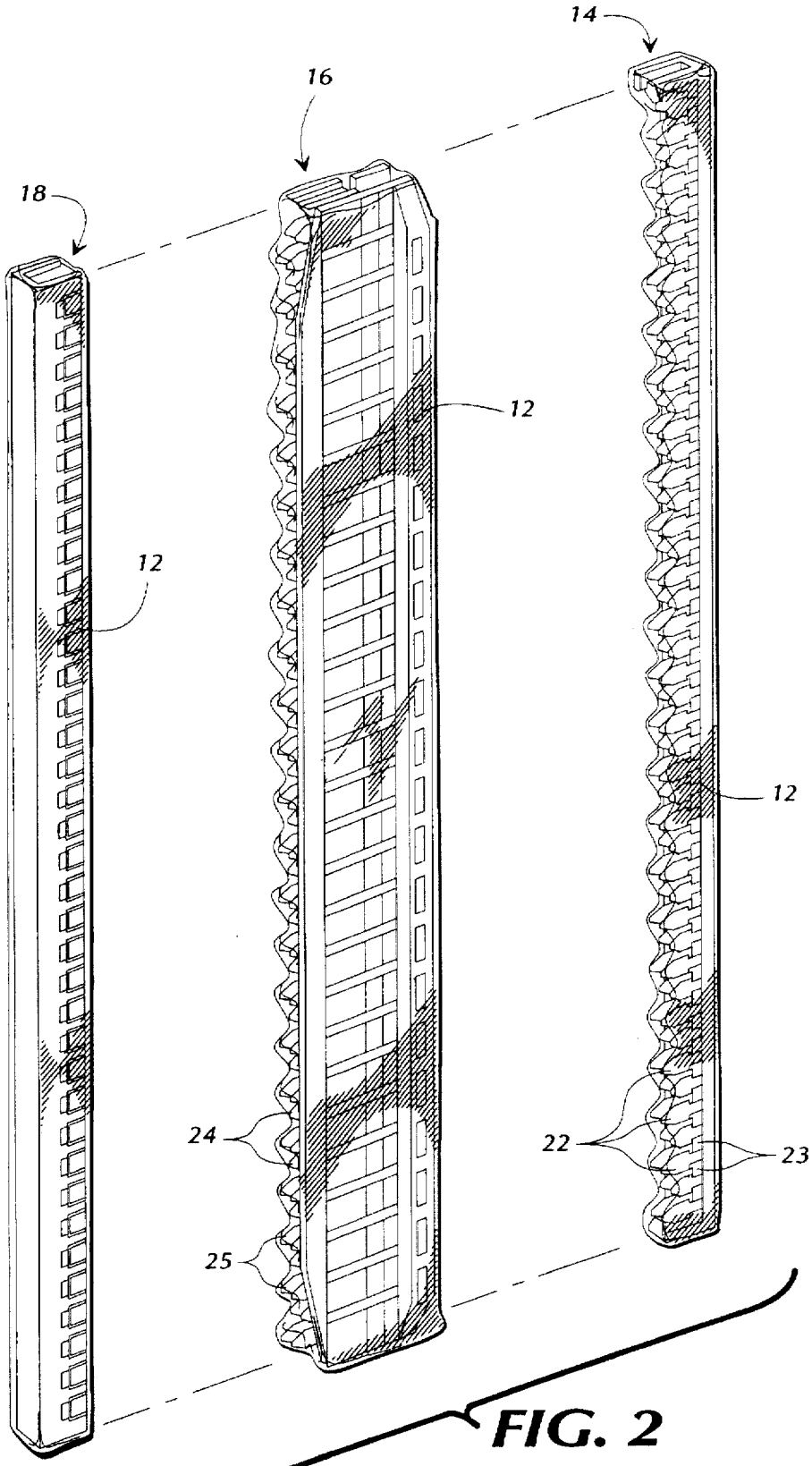
FIG. 2 is an exploded perspective view showing three parts of the connector of FIG. 1, each wrapped in heat shrink film.

The connector of the present invention comprises a connector 10 such as is known in the art which is protectively packaged with a heat shrink plastic film 12. Such packaging protects the connector and the spliced conductors 13, 15 contained within from contact with water, dirt, insects, and other contaminants.

For example, the connector can be one such as is taught in U.S. Pat. No. 3,858,158 to Henn et al. which is a three-part unit consisting of an index strip 14, a connector module 16, and a cap 18. In the present invention, each of the three parts is separately wrapped in heat shrink thermoplastic film 12. It would be extremely difficult, if not impossible, for a technician in the field to shrink wrap a pre-assembled connector with its conductors. Thus, the pieces of the connector are individually wrapped prior to assemblage in the field. Preferably, each piece is wrapped soon after its manufacture (or fillage with filling compound) so that it is protected from contact with contaminants from that time.

The heat shrink thermoplastic film of the present invention can be a type such as is known in the art. Examples of appropriate heat shrink films are those made of polyvinyichlorides, polyethylenes, and polypropylenes. In addition, the film may be a type which is dual or multi-layer and which may comprise a water impervious layer. One restriction on the film is that it be of appropriate thickness so that it does not interfere with the assembly of the connector pieces to hold the multiple conductors, as discussed hereafter. An appropriate thickness is approximately from 0.1 to 3.0 mil.

The film can be applied to the connector pieces through methods known in the art as discussed hereinbefore. In general, the film is preformed into a pouch or tube and the piece is inserted therein. Alternatively, the film can be wrapped in a sheet of the film material. The film with its enclosed connector piece is then heated, such as by passing through a hot air tunnel or by insertion in hot water. This causes the enclosing heat shrink film to shrink around the connector piece and produce a tight wrapping that closely conforms to the contours of the connector piece.

Prior to being enclosed in the heat shrink film, many connectors are filled with filling compound as known in the art. If desired, the filling compound can include a fungicide and corrosion inhibitor, as taught in pending application Ser. No. 08/489,423 to Bair et al. Because the connector pieces are wrapped by the film according to the present invention they do not need to be additionally packaged for shipment, thus saving on the overall expenses of manufacturing and shipping the connector. In addition, each piece is individually protected from the moment of its manufacture.

Figure 3:
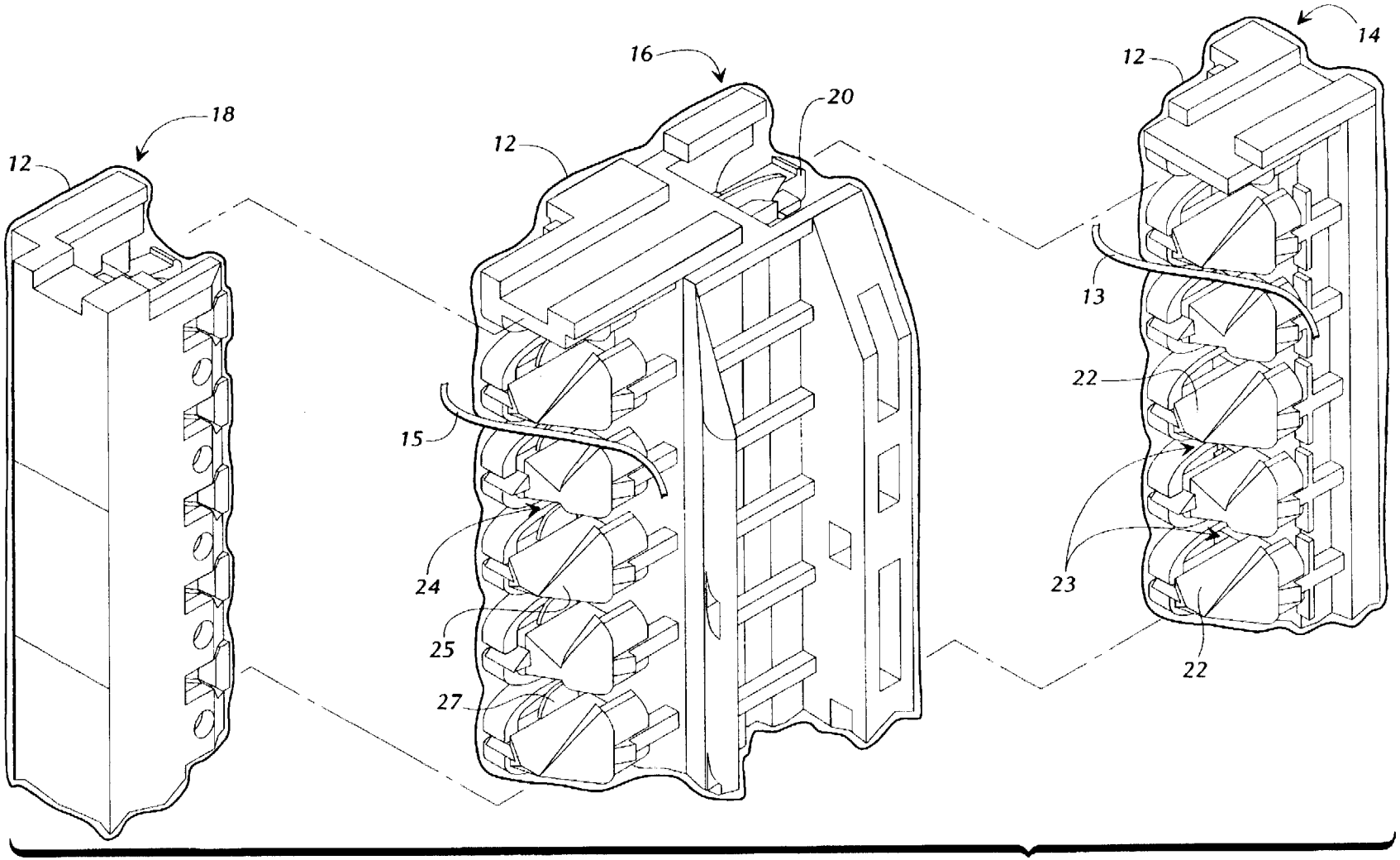
FIG. 3 is an exploded perspective view showing the method of assembly of the connector.
Figure 4:
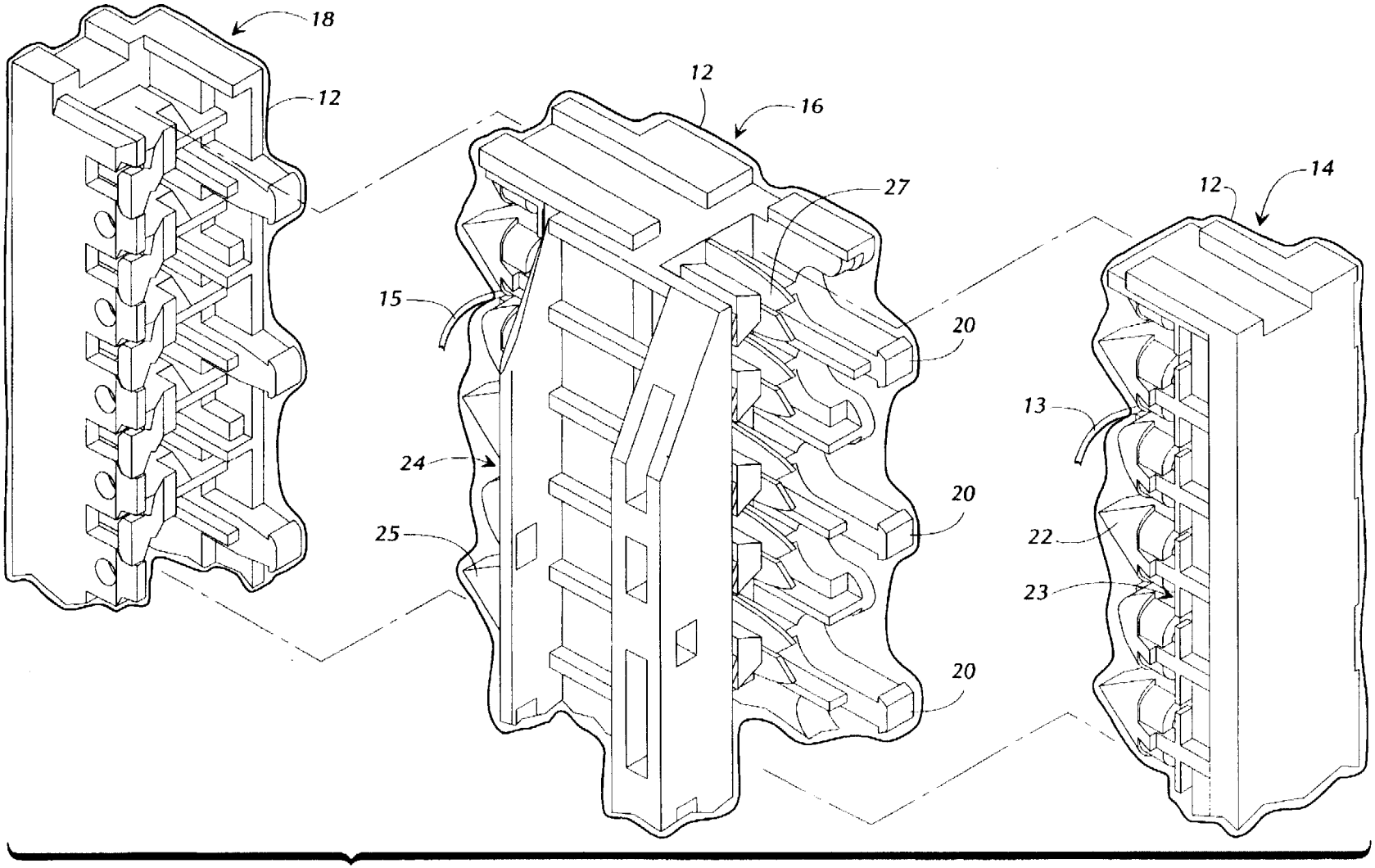
FIG. 4 is an exploded second perspective view showing the method of assembly of the connector.

The connector pieces wrapped as above can be assembled with their enclosed spliced conductors as known in the art and taught in the Henn et al. patent referenced above and as shown in FIGS. 3 and 4. Briefly, to assemble the connector with its spliced conductors, the splicer first places the index strip 14 into the guide tabs of an appropriately designed tool (not shown). Then, using the alternate peaked teeth 22 of the strip 14 as a visual and physical guide, the splicer locates and manipulates the ends of conductors 13 into position in the conductor slots 23 on either side of each peaked tooth 22. The toolhead is applied to the strip, snubbing the conductors down into position in the conductor slots 23. This step causes the conductors to puncture the film 12 at the point where the conductors contact the index strip 14 so that the conductors 13 will fit snugly into the slots 23. Then, the connector module 16 is placed in the same guide tabs of the tool, and pressed to fit onto index strip 14. Legs 20, as best seen in FIG. 4, of connector module 16 snap into slots (not shown) of index strip 14 to hold the pieces together. At the same time, internal conductive contact elements 27 of the connector module make contact with the conductors 13 by slicing through the insulation of the conductors 13 and effecting electrical and mechanical connection to the underlying wire. Where the film 12 overlies the conductors 13 it will be punctured by the contact elements to allow electrical connection between the contact elements and the conductors. Then, other conductors 15 are positioned into the connector module conductor slots 24 on either side of teeth 25, and the toolhead is again applied to snub down the conductors into the slots 24. This causes the conductors 15 to pierce the film 12 at the points where the conductors 15 contact the connector module 16. The internal conductive contact element 27 of the connector module pierces the insulation of the conductors 15 and electrically contacts the conductors 15 in the connector module 16 and the conductors 13 in the indexing strip 14. Finally, the cap 18 is applied using the same guide tabs of the tool and is snap mounted onto the module 16.

EXAMPLE

A sheet of polyethylene plastic film having a thickness of 1.0 mil was placed on a conveyor belt. A connector piece was placed on the plastic sheet and the plastic sheet was folded over the connector piece. The plastic thus surrounding the connector piece was cut to a proper length and the assembly was passed through a 2½ foot long heated shrink wrap tunnel. Upon exit from the tunnel, the connector piece was properly wrapped in the shrink-wrapped material. Each of the three pieces, an index strip, a connector module, and a cap were wrapped in shrink wrap according to the example. The three pieces were then assembled as per the usual method of assembly with multiple conductors connected thereto.

While the invention has been disclosed and described as pertaining to a three piece connector for connecting multiple connectors, it is anticipated that the invention is additionally applicable to other types of connectors, such as, for example, individual splice connectors for connecting two wires. Various additional modifications and extensions of this invention will become apparent to those skilled in the art. All such variations and deviations which basically rely on the teachings through which this invention has advanced the art are properly considered to be within the spirit and scope of this invention.

I claim:

1. A connector assembly for connecting two or more conductors, said assembly comprising a plurality of connector parts adapted to be fitted together to form the connector assembly;

each of said connector parts being individually and completely enclosed in a protective covering prior to the forming of the connector assembly, said coverings comprising a heat shrink thermoplastic film;

wherein said two or more conductors and said plurality of connector parts can be fitted together through said coverings.

2. The connector assembly of claim 1, wherein said connector comprises an index strip, a connector module, and a cap, and each of said index strip, connector module, and cap is individually surrounded by said covering of said heat shrink thermoplastic film.

3. The connector assembly of claim 1, wherein said heat shrink film is a polymer selected from the group consisting of polyethylene, polypropylene, and polyvinylchloride.

4. The connector assembly of claim 1, wherein the heat shrink film has a thickness of from about 0.1 to 3.0 mil.

5. The connector assembly of claim 2, wherein at least one of said wrapped index strip, connector module, and cap is filled with a filling compound.

6. A cable connector assembly for connecting a plurality of conductors, said connector assembly having first and second separate parts, each of said parts being adapted to make electrical connections to each of said plurality of conductors; and means for forming a protective coating for said connector assembly, said means comprising first and second separate thermoplastic films completely enclosing said first and second parts respectively, each of said first and second thermoplastic films being heat shrunk onto its respective part, wherein said plurality of conductors and said first and second connector parts can be fitted together to form said connector assembly through said thermoplastic films.

* * * * *